US006154108A

United States Patent [19]

Huang

[11] Patent Number: 6,154,108

[45] Date of Patent: Nov. 28, 2000

[54] FASTENER ATTRACTING DEVICE FOR TOOL

[76] Inventor: Li Shiu Huang, No. 105, Tsu Ah Lane Chong San Road San Her Tsuen, Wu Zh Hsiang, Taichung Hsien, Taiwan

[21] Appl. No.: 09/413,179

[22] Filed: Oct. 7, 1999

[51] Int. Cl.[7] ..... H01F 7/20

[52] U.S. Cl. ..... 335/284; 81/125; 81/451

[58] Field of Search ..... 335/284, 285; 81/121.1, 125, 438, 451, 429

[56] References Cited

U.S. PATENT DOCUMENTS

| | | | |
|---|---|---|---|
| 5,168,781 | 12/1992 | Tenuta | 81/121.1 |
| 5,182,973 | 2/1993 | Martindell | 81/429 |
| 5,724,873 | 3/1998 | Hillinger | 81/451 |
| 5,861,789 | 1/1999 | Bundy et al. | 335/285 |
| 5,938,212 | 8/1999 | Wadsworth | 279/42 |
| 5,954,463 | 9/1999 | Jore | 408/239 R |
| 6,006,630 | 12/1999 | Vasichek et al. | 81/125 |

*Primary Examiner*—Lincoln Donovan
*Assistant Examiner*—Tuyen Nguyen
*Attorney, Agent, or Firm*—Charles E. Baxley

[57] ABSTRACT

An attracting device may be detachably attached onto a tool and includes a chamber for receiving a magnet which is used for attracting fasteners to the tool. A spring-biased ball is engaged onto the attracting device and biased to engage with the tool by a resilient retaining ring, for detachably securing the attracting device onto the tool. A ferrule is rotatably engaged onto the tool for shielding and protecting the resilient retaining ring. The magnet includes a cavity for receiving a head of the tool.

7 Claims, 4 Drawing Sheets

FASTENER ATTRACTING DEVICE FOR TOOL

BACKGROUND OF THE INVENTION

1. Field of the Invention

The present invention relates to an attracting device, and more particularly to a fastener attracting device for attaching onto the tools.

2. Description of the Prior Art

Typical tools, particularly the screw drivers, comprise a driving stem for engaging with and for driving the fasteners. Some of the driving stems are magnetized for attracting the fasteners. However, most of the driving stems are not magnetized and may not be used for attracting the fasteners.

The present invention has arisen to mitigate and/or obviate the afore-described disadvantages of the conventional tools.

SUMMARY OF THE INVENTION

The primary objective of the present invention is to provide an attracting device for attaching onto the tools and for attracting the fasteners to the tools and for allowing the fasteners to be easily driven by the tool.

In accordance with one aspect of the invention, there is provided an attracting device for attaching onto a tool and for attracting fasteners, the attaching device comprising a body including a chamber formed therein, a magnet received in the chamber of the body for attracting the fasteners, and means for detachably securing the body onto the tool.

A retaining device is further provided for retaining the magnet in the chamber of the body and includes a peripheral flange extended radially inward from the body for engaging with the magnet and for securing the magnet to the body.

The magnet includes a bore formed therein for receiving the tool. The body includes an extension having an orifice formed therein for receiving the tool, and the detachably securing means is provided for securing the extension of the body onto the tool. The extension of the body includes an aperture formed therein, the detachably securing means includes a spring-biased ball engaged in the aperture of the extension of the body and biased to engage with the tool for securing the extension of the body onto the tool.

The detachably securing means includes a resilient retaining ring engaged onto the ball for biasing the ball to engage with the tool and for securing the extension of the body onto the tool. The extension of the body includes a peripheral recess formed therein for receiving the resilient retaining ring and for retaining the resilient retaining ring to the extension of the body.

A ferrule is further rotatably engaged onto the extension of the tool for shielding the resilient retaining ring. The magnet includes a cavity formed therein for receiving a head of the tool.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
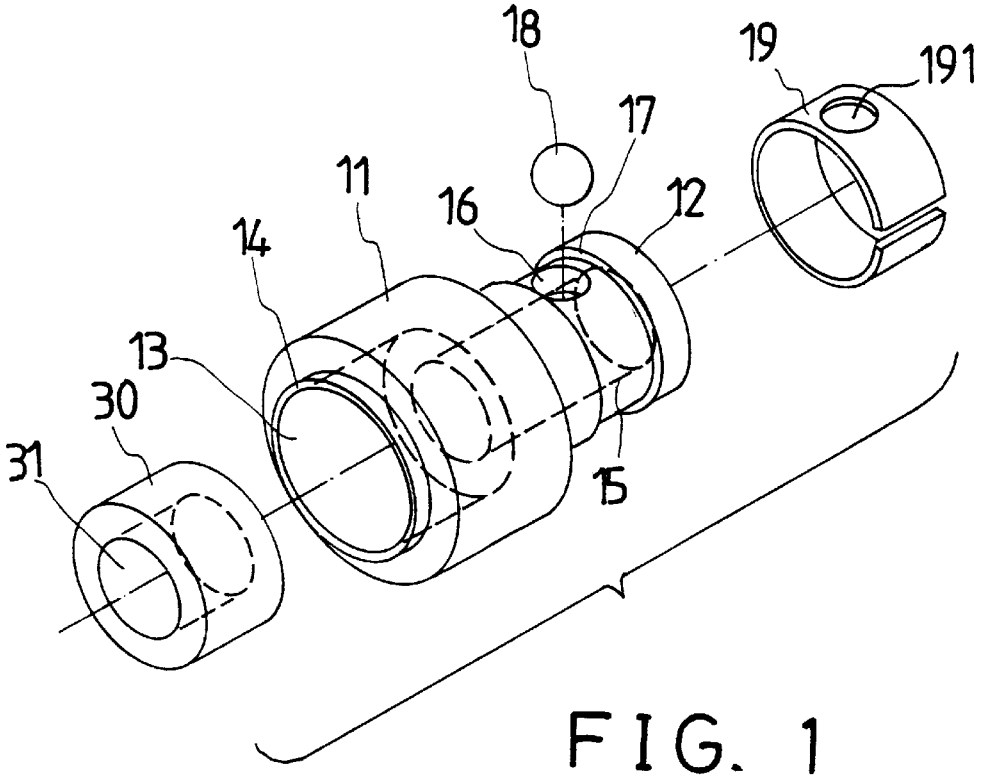
FIG. 1 is an exploded view of an attracting device in accordance with the present invention for attaching onto a tool and for attracting fasteners.
Figure 2:
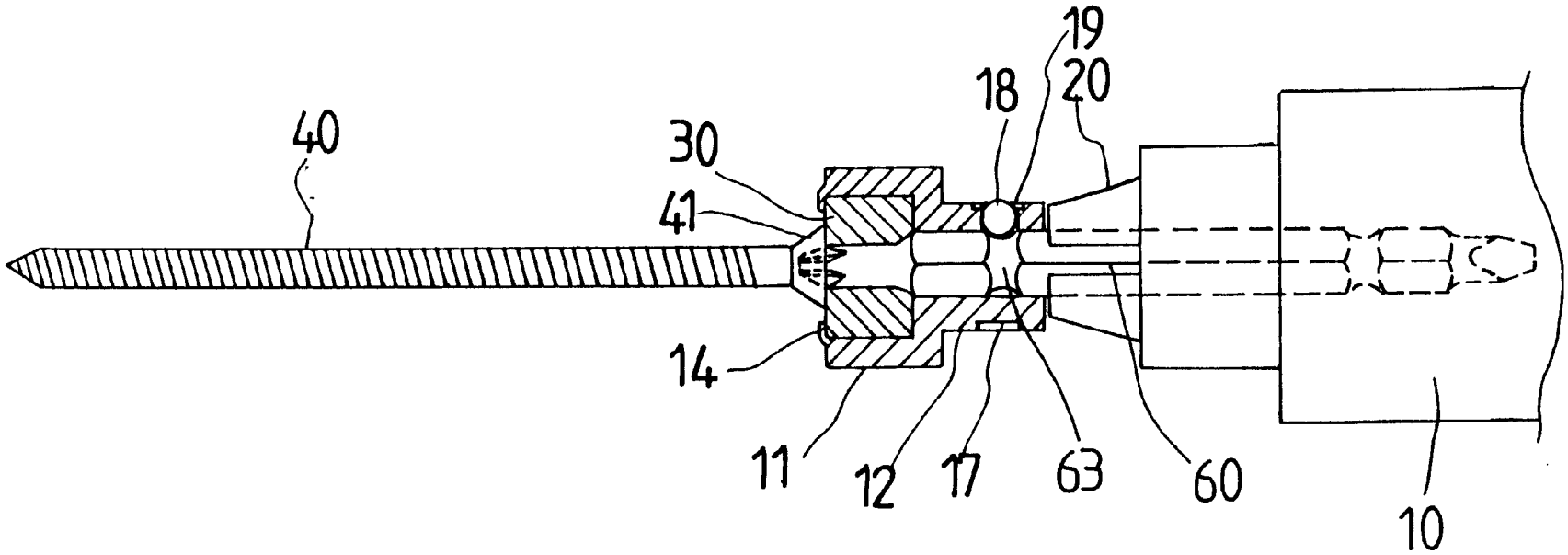
FIG. 2 is a cross sectional view of the attracting device, illustrating the operation of the attracting device.

Referring to the drawings, and initially to FIGS. 1 and 2, an attracting device in accordance with the present invention comprises a body 11 including a chamber 13 formed therein for receiving a magnet 30 and including a peripheral flange 14 forced to be extended radially inward for engaging with the magnet 30 and for securing the magnet 30 within the chamber 13 of the body 11. The body 11 includes an extension 12 extended therefrom and having an orifice 15 formed therein for receiving a tool 60, particularly the driving stem or the driving tool bit 60 of a screw driver, which may be secured to a power tool 10 by a chuck device 20. The tool 60 includes a peripheral groove 63 formed therein. The magnet 30 includes a bore 31 formed therein for receiving the tool 60 and for allowing the tool 60 to be extended outward of the magnet 30 to engage with the head 41 of the fastener 40 to be driven by the tool 60 (FIG. 2).

The extension 12 of the body 11 includes an aperture 16 formed therein and communicating with the orifice 15 thereof for receiving a ball 18. A resilient retaining ring 19 is engaged onto the extension 12 of the body 11 and engaged with the ball 18 for biasing the ball 18 inward of the orifice 15 of the extension 12 of the body 11 to engage into the peripheral groove 63 of the tool 60 and to detachably secure the body 11 of the attracting device onto the tool 60. It is preferable that the extension 12 of the body 11 includes a peripheral recess 17 formed therein for receiving the resilient retaining ring 19 and for retaining the resilient retaining ring 19 to the extension 12 of the body 11. The resilient retaining ring 19 preferably includes a hole 191 formed therein and having a size slightly smaller than that of the ball 18 for securing the ball 18 to the extension 12 of the body 11.

Figure 3:
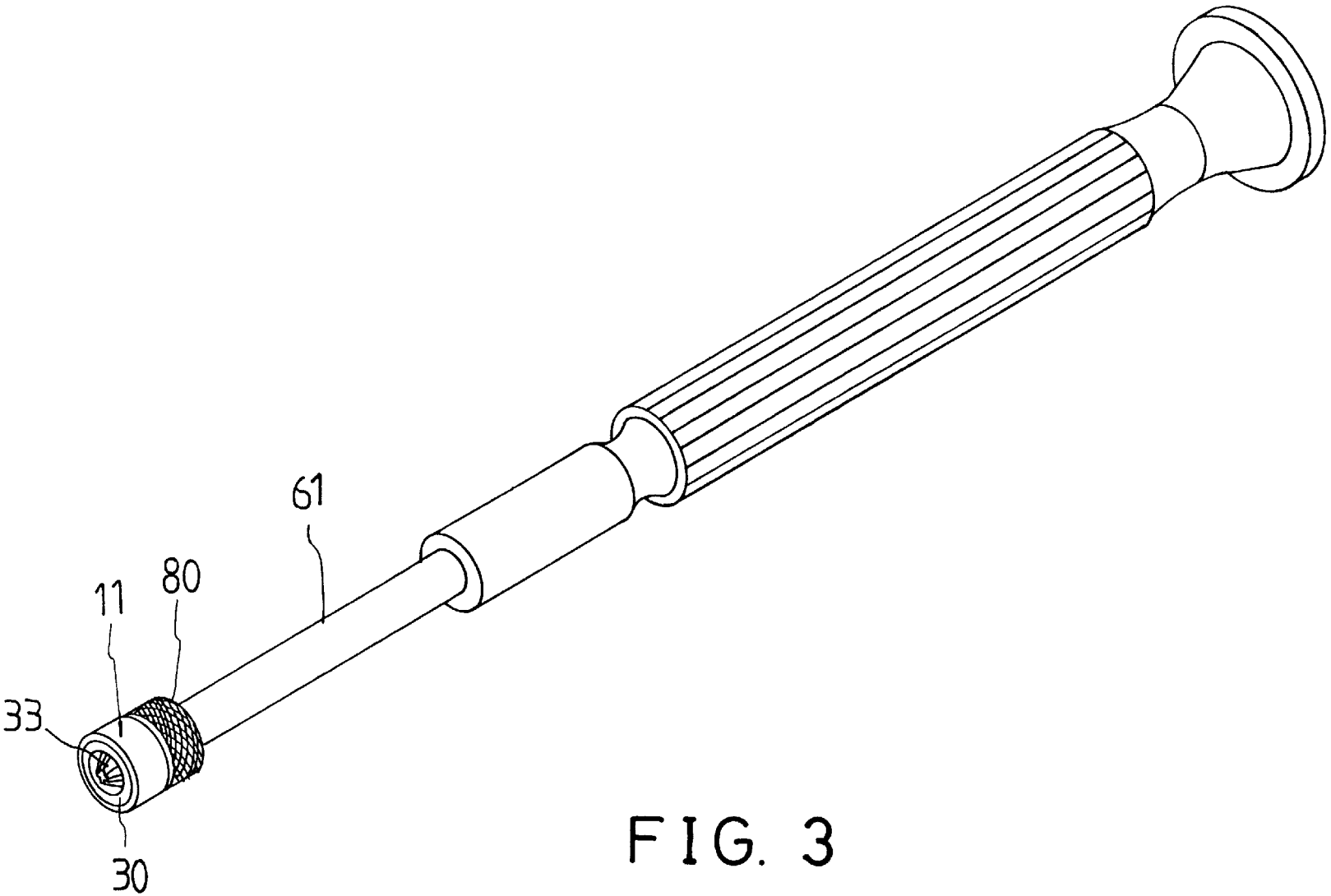
FIG. 3 is a perspective view illustrating the application of the attracting device to the tool.
Figure 5:
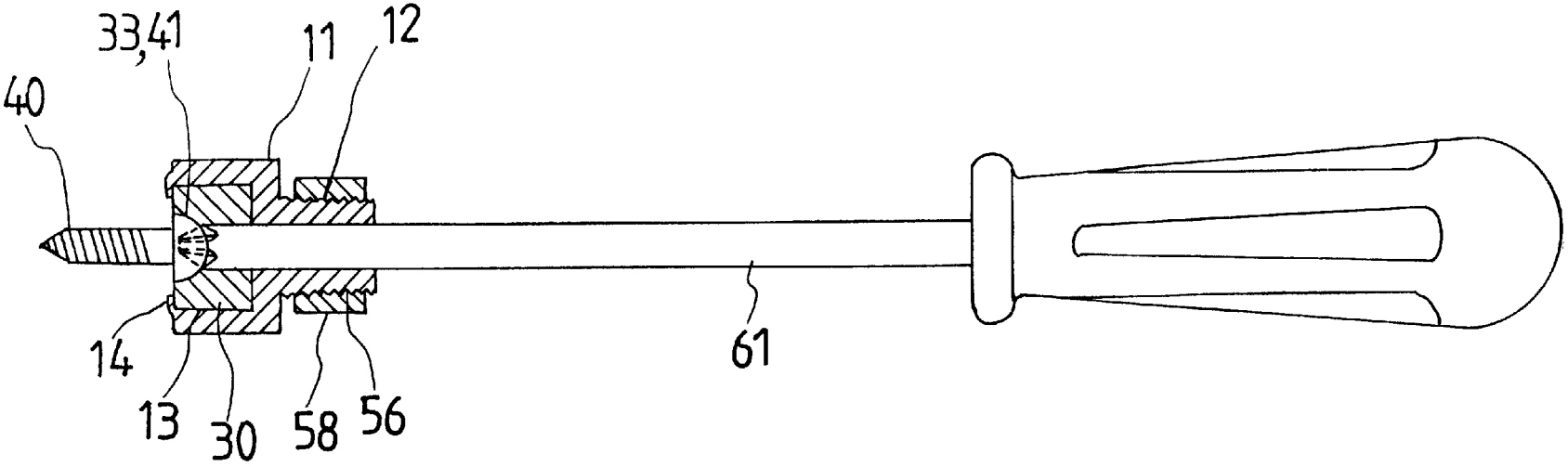
FIG. 5 is a cross sectional view of the attracting device as shown in FIG. 4, illustrating the operation of the attracting device.

Referring next to FIG. 3, the body 11 of the fastener attracting device may also be attached onto the driving stem 61 of the typical screw driver that has no peripheral groove formed therein. The resilient retaining ring 19 may also bias the ball 18 to engage with the driving stem 61 of the tool and to secure the body 11 onto the driving stem 61. It is to be noted that the magnet 30 is provided for attracting the fasteners only and need not be driven by the tool and need not apply a force against the fastener, such that the engagement of the spring-biased ball 18 with the driving stem 61 is good enough to secure the body 11 onto the driving stem 61. The magnet 30 may include a semi-spherical cavity 33 formed therein for receiving the head 41 of the fastener 40 that has a semi-spherical shape (FIG. 5). A ferrule 80 may further be provided and rotatably engaged onto the extension 12 of the body 11 for shielding the resilient retaining ring 19 and for protecting the resilient retaining ring 19.

Figure 4:
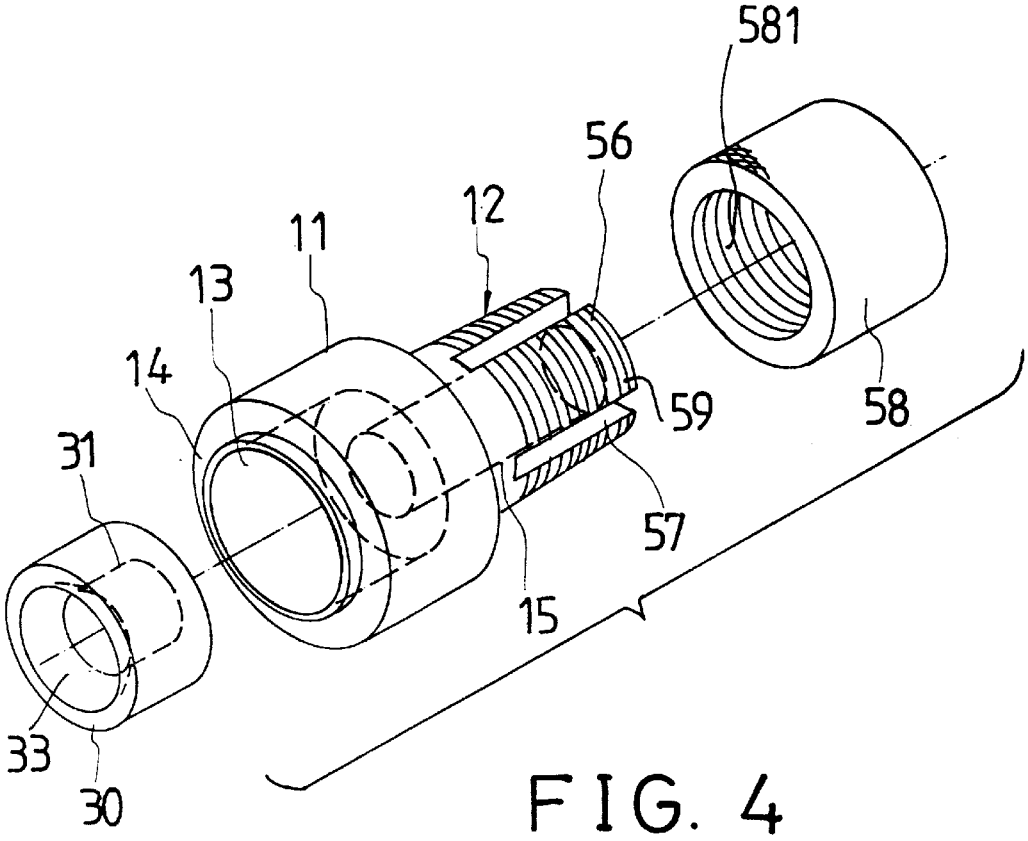
FIG. 4 is an exploded view illustrating the other application of the attracting device.

Referring next to FIGS. 4 and 5, for solidly securing the driving stem 61 of the typical screw driver that has no peripheral groove formed therein, the extension 12 of the body 11 may include one or more slits 57 formed therein for defining one or more flaps 59 and may include an outer thread 56 formed thereon for threading with an inner thread 581 of a control ferrule 58. The control ferrule 58 may force the flaps 59 radially inward to engage with the driving stem 61 and to solidly secure the body 11 onto the driving stem 61 when the control ferrule 58 is threaded onto the extension 12.

Alternatively, the body 11 may include a peripheral chamber formed therein for receiving one or more magnets or magnetic rollers therein, or may include a side chamber for receiving one or more magnets. The magnets are provided for attracting the fastener to the tool only.

Accordingly, the fastener attracting device in accordance with the present invention may be used for attaching onto the tools and for attracting the fasteners to the tools and for allowing the fasteners to be easily driven by the tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An attracting device for a tool and for attracting fasteners, said attaching device comprising:

a body including a chamber formed therein, said body including an extension having an orifice formed therein for receiving the tool, said extension of said body including an aperture formed therein, a magnet received in said chamber of said body for attracting the fasteners, and means for detachably securing said body onto the tool, said detachably securing means being provided for securing said extension of said body onto the tool and including a spring-biased ball engaged in said aperture of said extension of said body and biased to engage with the tool for securing said extension of said body onto the tool, said detachably securing means including a resilient retaining ring engaged onto said spring-biased ball for biasing said spring-biased ball to engage with the tool and for securing said extension of said body onto the tool.

2. The attracting device according to claim 1 further comprising means for retaining said magnet in said chamber of said body.

3. The attracting device according to claim 2, wherein said retaining means includes a peripheral flange extended radially inward from said body for engaging with said magnet and for securing said magnet to said body.

4. The attracting device according to claim 1, wherein said magnet includes a bore formed therein for receiving the tool.

5. The attracting device according to claim 1, wherein said extension of said body includes a peripheral recess formed therein for receiving said resilient retaining ring and for retaining said resilient retaining ring to said extension of said body.

6. The attracting device according to claim 1 further comprising a ferrule rotatably engaged onto said extension of said body for shielding said resilient retaining ring.

7. The attracting device according to claim 1, wherein said magnet includes a cavity formed therein for receiving the fastener.

* * * * *